US005499035A

United States Patent [19]

Smith, Jr. et al.

[11] Patent Number: 5,499,035

[45] Date of Patent: Mar. 12, 1996

[54] PHASED ARRAY ANTENNA APERTURE AND METHOD

[75] Inventors: Richard G. Smith, Jr., Marietta, Ga.; Calvin L. Gee, Buda, Tex.

[73] Assignee: Texas Instruments Incorporated, Dallas, Tex.

[21] Appl. No.: 95,776

[22] Filed: Jul. 21, 1993

[51] Int. Cl.[6] ..... H01Q 1/12

[52] U.S. Cl. ..... 343/789; 343/770; 343/872; 343/879

[58] Field of Search ..... 343/872, 853, 343/795, 789, 767, 878, 879, 770, 893; H01Q 1/12, 1/38, 1/42

[56] References Cited

U.S. PATENT DOCUMENTS

| | | | |
|---|---|---|---|
| 4,001,834 | 1/1977 | Smith | 343/795 |
| 4,500,887 | 2/1985 | Nester | 343/795 |
| 4,573,056 | 2/1986 | Dudome et al. | 343/795 |

OTHER PUBLICATIONS

"Antenna/Nonmetallics Department Solves a Variety of Packaging Challenges", Williams et al. TI Technical Journal, May–Jun., 1992, pp. 25–42.

*Primary Examiner*—Michael C. Wimer

*Attorney, Agent, or Firm*—René E. Grossman; Richard L. Donaldson

[57] ABSTRACT

A phased antenna array which includes a single piece electrically conductive faceplate which uses accurately positioned posts with precision formed grooves in the post faces to obtain accurate board placement of the boards relative to each other. The element boards penetrate through slots in the bottom portion of the faceplate and rest in the precision formed grooves in the posts at opposing sides of a slot with the board edges restrained by the grooves in the posts. The portions of each element board extending out of the slots are accurately positioned by providing holes in each of the element boards through which pins are positioned to accurately determine the amount of entry of the elements into the slots. As an alternative, some or all of the element boards can be secured to an external structure which does not move relative to the faceplate to accurately position the boards relative to the faceplate. Since the faceplate is electrically conductive, electrical connection from the faceplate to a board can be made by disposing electrically conductive material on the board on a surface portion thereof that contacts the faceplate. The element boards each have an electrically conductive pattern disposed thereon.

12 Claims, 2 Drawing Sheets

PHASED ARRAY ANTENNA APERTURE AND METHOD

BACKGROUND OF THE INVENTION

1. Field of the Invention

This invention relates to a phased array antenna aperture design and method of making same and, more specifically, to a support structure for supporting and positioning flared notch antenna elements and method.

2. Brief Description of the Prior Art

Typical flared notch phased arrays are composed of flared notch antenna elements (single, dual or quad notch elements) etched on dielectric circuit boards. The notch elements are bound together by either epoxy or by solder to form the array. For the array to perform at an optimum level, each element must have the same electrical performance including element amplitude and phase match. To achieve the repeatability or uniformity from element to element, the location of each element must be tightly controlled to insure a proper phase location in the array. Since mutual coupling between the elements also affects the electrical performance of the antenna, the location of a single element affects the performance of surrounding elements. Electrical continuity between elements must also be maintained to eliminate any additional impedance matching problems. Prior art antenna array designs and fabrication techniques have not delivered the mechanical rigidity and accuracy required to obtain optimum electrical performance. It is therefore apparent that improved techniques are required for accurate element positioning and maintenance of the accurate position if repeatability and uniformity are to be achieved on a more economic basis.

SUMMARY OF THE INVENTION

In accordance with the present invention, there is provided an antenna structure which obtains the accurate and permanent mechanical positioning of notch antenna elements on a repeatable and uniform basis and also provides electrical continuity between the array elements.

Briefly, the above is accomplished by providing a single piece electrically conductive, preferably aluminum, faceplate or housing which uses accurately positioned posts therein with precision formed grooves in the post faces to obtain accurate board placement of the boards relative to each other. The element boards penetrate through slots in the bottom portion of the faceplate aligned with grooves of adjacent posts, the slots forming extensions of the grooves. The boards rest in the precision formed grooves in the posts at opposing sides of a slot with the board edges restrained by the grooves in the posts. The portions of each element board extending out of the slots are accurately positioned by providing holes in the element boards through which pins are positioned or other methods are used to accurately determine the amount of entry of the elements into the slots. As an alternative, some or all of the element boards can be secured to an external structure which does not move relative to the faceplate to accurately position the boards relative to the faceplate. Since the faceplate is electrically conductive, electrical connection from the faceplate to a board can be made by disposing electrically conductive material on the board on a surface portion thereof that contacts the faceplate. The element boards each have an electrically conductive pattern disposed thereon.

The structure in accordance with the present invention provides accurate positioning of all of the elements across the face of the array and retains rigid positioning if the array undergoes any vibration. Prior art designs have left the elements unrestrained or used epoxy or soldering to attach the elements together. These techniques do not yield accurate board placement across the face of the array and do not yield any mechanical rigidity. In addition, the novel arrangement provides a rigid structure for supporting and positioning electrical and cooling nanifolding of the phased array system. Prior art techniques have not provided any surface for mechanical support of interior components of the array.

The structure of the present invention provides positional stability in that the width, length and shape of the support posts can be varied to provide accurate mechanical control to meet any environmental effects. The prior art relied upon solder or epoxy strength for positional control. Since the faceplate is composed of aluminum, any thermal expansion problems are avoided since most antenna support structures or cooling structures are typically composed of similar material. Typical dielectric aperture construction suffers due to differences of the thermal expansion properties of the dielectrics and metals. These differences can lead to structural failure. Still further, the faceplate provides an additional support surface for supporting and positioning interior components of the array such as electrical and cooling manifolds. Prior art epoxy or solder designs did not yield the mechanical strength necessary to provide an interior supporting structure. In addition, the positional integrity of the posts, slots and back plane insures that the electrical environment seen by each element is the same. Also, by plating the edges of the boards, the fields which normally propagate between boards are eliminated. This eliminates the need for the boards to be bonded or soldered into place for electrical integrity which allows the elements to be removed and serviced more easily. Further, the accurate construction of the faceplate is achieved by using mature technologies, such as precision milling, EDM, molding, etc. to insure positional accuracy.

DESCRIPTION OF THE PREFERRED EMBODIMENT

Figure 1:
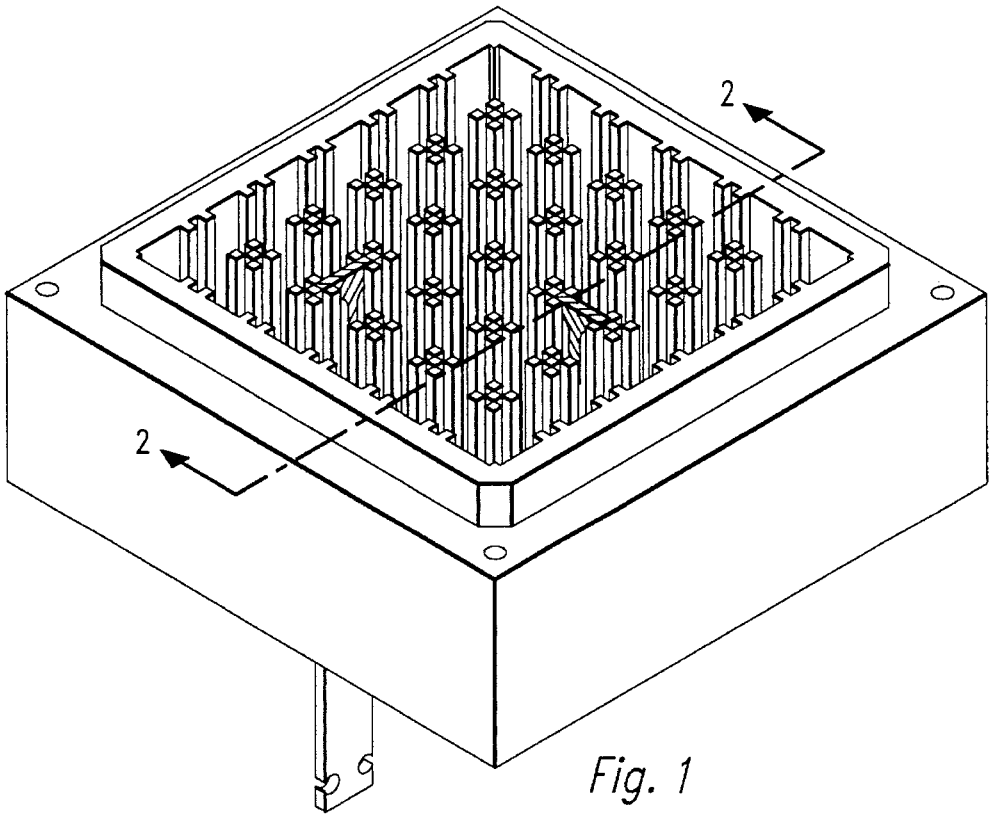
FIG. 1 is a top perspective view of a faceplate with array elements therein in accordance with the present invention.
Figure 2:
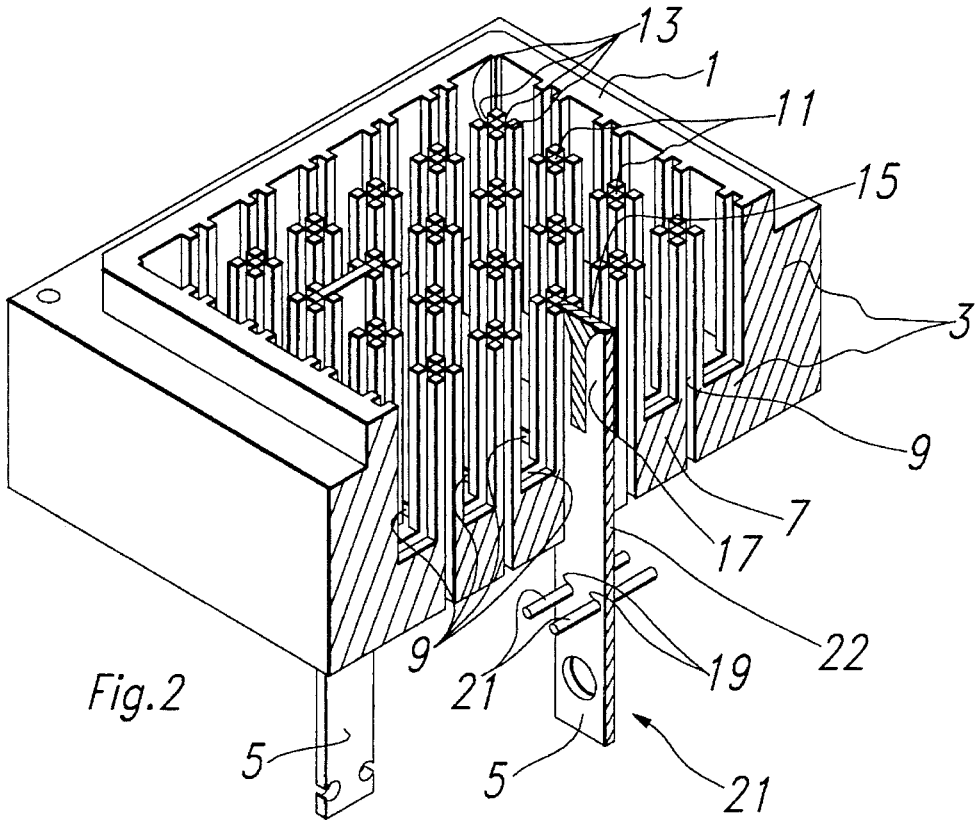
FIG. 2 is a top perspective view of a faceplate with array elements therein and cutaway along the line 3—3 of FIG. 1.
Figure 3:
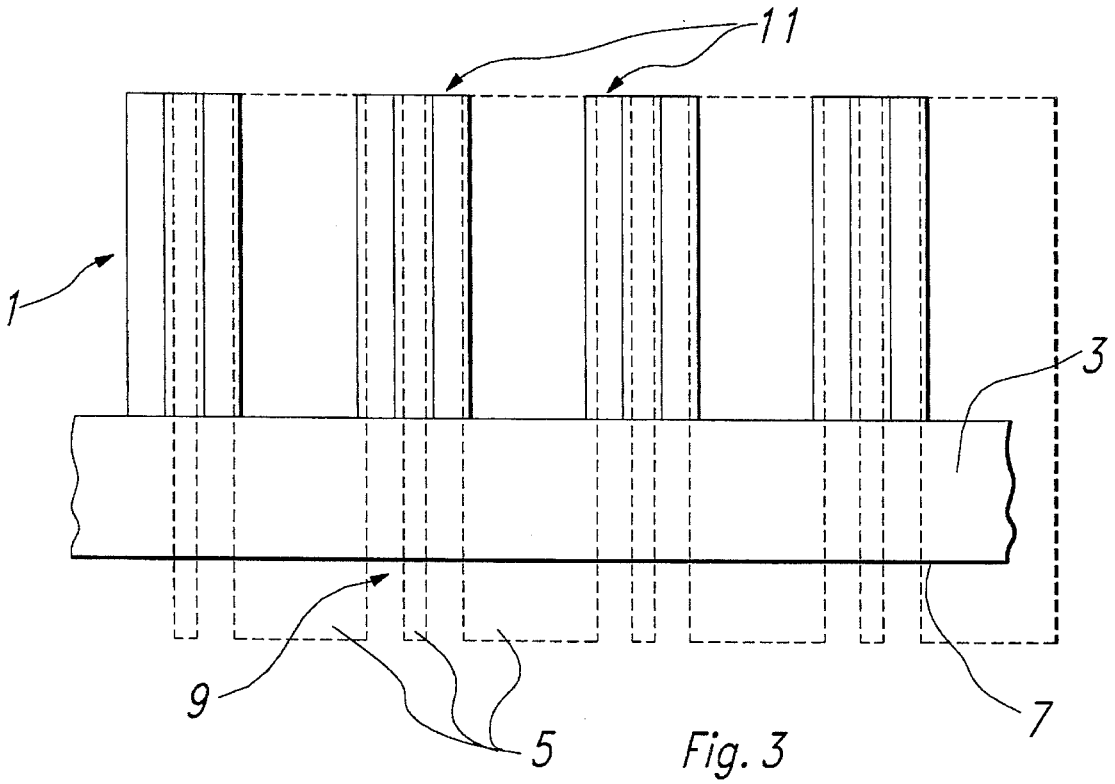
FIG. 3 is a cross sectional view taken along the line 3—3 of FIG. 1.

Referring to FIGS. 1 to 3, there is shown an antenna structure 1 in accordance with the present invention. The antenna structure 1 includes a faceplate 3 and antenna array elements 5 disposed in the faceplate and extending out of the bottom portion of the faceplate (FIGS. 4*a* and 4*b*).

The faceplate 3 is formed of an electrically conductive metal, preferably aluminum, and includes a bottom surface 7 having slots 9 therein, the slots being disposed in two sets of parallel rows, the two sets of rows being orthogonal to each other. The faceplate also includes a plurality of posts 11, each post being disposed at the intersection of a pair of orthogonally disposed slots to provide the separation of adjacent slots in each of the adjacent rows. The posts 11 extend into the faceplate 3 each post preferably being rectangular and having precision formed grooves 13 accurately disposed in each wall thereof for precision reception therein of an edge portion of an antenna array element 5. The grooves 13 are aligned with the slots 9 so that an antenna element 5 inserted into a slot will move through the slot and along and within grooves on opposite sides of the slot. The antenna element is inserted into the slot a predetermined distance as will be explained hereinbelow.

The grooves 13 in the posts 11 are precision milled and can be formed at the same time that the slots 9 are formed. This provides the very close tolerances required for accurate positioning of the antenna array elements 5 relative to each other.

Figure 4A:
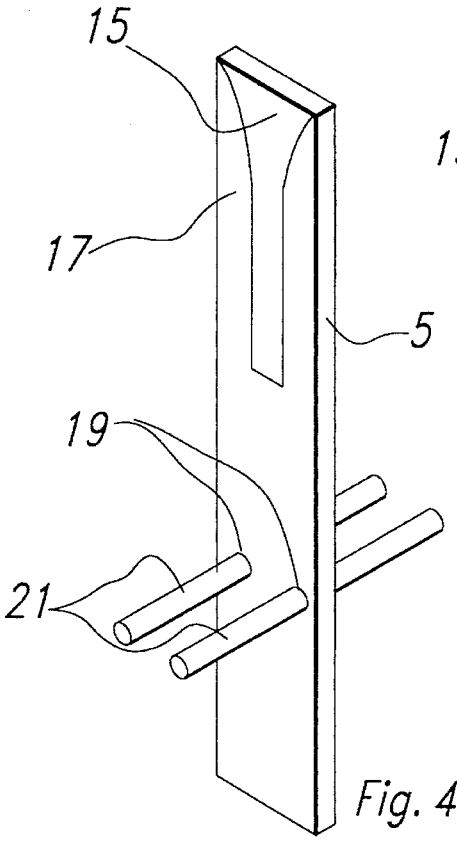
FIGS. 4*a* and 4*b* are top views of array element as shown in FIGS. 1 to 3.
Figure 4B:
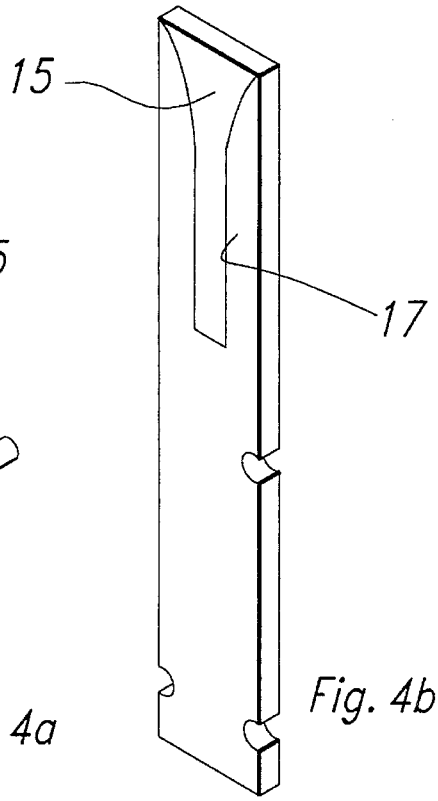

The antenna array elements 5 are best shown in FIGS. 4*a* and 4*b* and include a plastic board portion 15 having an electrically conductive pattern 17 thereon, preferably formed of copper in standard printed circuit board manner, such as by silk screening, etc. In the event electrical connection is to be made to the faceplate 3, the electrically conductive pattern 17 will extend on the board portion 22 to an edge portion thereof to contact the electrically conductive faceplate. A pair of holes 19 extends through each antenna array element 5 (FIG. 4*a*) and is provided to accurately determine the extent of entry of the element into the faceplate. This is accomplished by placing pins 21 in each of the holes 19 so that the pins contact the outer surface of the faceplate when the desired position has been achieved. As an alternative (FIG. 4*b*), the holes 19 can be omitted and one or more of the antenna array elements 5 can be secured to an external structure (not shown) which, in turn, maintains constant position relative to the faceplate 3. Electrical connection to the external structure can be achieved by permitting the electrically conductive pattern to extend along the element 5 out of the faceplate 3 and to the external structure.

Though the invention has been described with respect to specific preferred embodiments thereof, many variations and modifications will immediately become apparent to those skilled in the art. It is therefore the intention that the appended claims be interpreted as broadly as possible in view of the prior art to include all such variations and modifications.

We claim:

1. A phased array antenna which comprises:

(a) an electrically conductive faceplate having a bottom surface and a plurality of electrically conductive posts extending in a direction normal to said bottom surface and disposed on said bottom surface, said posts disposed in a predetermined configuration, said bottom surface having a plurality of slots therein;

(b) each of said posts having a plurality of grooves extending in a direction normal to said bottom surface, each of said grooves aligned with a groove from a different one of said posts and with a said slot in said bottom surface, whereby said aligned grooves and said slot in said bottom surface lie in a single plane; and (c) a plurality of antenna array elements, each of said antenna array elements having an electrically conductive pattern disposed thereon, each of said antenna array elements being secured within an aligned pair of said grooves in a pair of said posts and a said slot aligned with said aligned pair of said grooves.

2. An antenna as set forth in claim 1 wherein said electrically conductive pattern is electrically connected to one of said pair of posts.

3. An antenna as set forth in claim 1 wherein said posts are arranged in a set of rows and columns.

4. An antenna as set forth in claim 2 wherein said posts are arranged in a set of rows and columns.

5. An antenna as set forth in claim 1 wherein each of said antenna array elements includes means to determine the locus thereof in said aligned grooves,.

6. An antenna as set forth in claim 2 wherein each of said antenna array elements includes means to determine the locus thereof in said aligned grooves.

7. An antenna as set forth in claim 3 wherein each of said antenna array elements includes means to determine the locus thereof in said aligned grooves.

8. An antenna as set forth in claim 4 wherein each of said antenna array elements includes means to determine the locus thereof in said aligned grooves.

9. A method of fabricating a phased array antenna which comprises the steps of:

(a) providing an electrically conductive faceplate having a bottom surface and a plurality of electrically conductive posts extending in a direction normal to said bottom surface and disposed on said bottom surface in a predetermined configuration, said bottom surface having a plurality of slots therein;

(b) providing a plurality of grooves extending in a direction normal to said bottom surface in each of said posts, each of said grooves aligned with a groove from a different one of said posts and with a said slot in said bottom surface, whereby said aligned grooves and said slot in said bottom surface lie in a single plane; and (c) moving an antenna array element having an electrically conductive pattern disposed thereon through a said slot and within an aligned pair of said grooves in a pair of said posts aligned with said slot aligned with said aligned pair of said grooves to a predetermined location including said aligned grooves and said slot.

10. The method of claim 9 wherein said step of moving an antenna array element through a said slot includes the step of connecting said electrically conductive pattern to one of said pair of posts.

11. The method of claim 9 wherein said step of providing said faceplate having posts includes the step of arranging said posts in a set of rows and columns.

12. The method of claim 10 wherein said step of providing said faceplate having posts includes the step of arranging said posts in a set of rows and columns.

* * * * *